US005636583A

United States Patent [19]

Müller

[11] Patent Number: 5,636,583

[45] Date of Patent: Jun. 10, 1997

[54] INDUSTRIAL SEWING MACHINE COMPRISING AN ELECTRONIC CONTROL MEANS AND SEWING METHOD

[76] Inventor: Ernst Müller, Steinacherstrasse 35, CH-9327 Tübach, Switzerland

[21] Appl. No.: 468,228

[22] Filed: Jun. 6, 1995

Related U.S. Application Data

[63] Continuation of Ser. No. 325,626, Oct. 19, 1994, abandoned, which is a continuation of Ser. No. 181,876, Jan. 13, 1994, abandoned, which is a continuation of Ser. No. 46,894, Apr. 15, 1993, abandoned, which is a continuation of Ser. No. 825,813, Jan. 21, 1992, abandoned, which is a continuation of Ser. No. 664,794, Mar. 5, 1991, abandoned.

[30] Foreign Application Priority Data

Mar. 5, 1990 [EP] European Pat. Off. ..... 90104202

[51] Int. Cl.[6] ..... D05B 19/00

[52] U.S. Cl. ..... 112/470.04; 112/470.05; 112/475.05

[58] Field of Search ..... 112/470.01, 470.04, 112/457, 458, 456, 445, 275, 277, 475.01, 475.05, 470.06, 470.05; 364/470, 400

[56] References Cited

U.S. PATENT DOCUMENTS

| | | | |
|---|---|---|---|
| 3,654,882 | 4/1972 | Kamena | 112/121.11 |
| 3,750,603 | 8/1973 | Martin | 112/121.11 X |
| 4,412,498 | 11/1983 | Scholl | 112/121.11 X |
| 4,703,432 | 10/1987 | Muller | 112/121.11 |
| 4,899,287 | 2/1990 | Hulshoff | 112/121.11 X |

*Primary Examiner*—Peter Nerbun

*Attorney, Agent, or Firm*—Burns, Doane, Swecker & Mathis, LLP

[57] ABSTRACT

An industrial sewing machine comprises an electronic control means triggering and controlling, dependent on the currently produced seam length, one of a variety of functions such as label insertion or cutting. Each seam length section is defined by the product of stitch length and stitch number. For this purpose, the control means processes one or several given stitch lengths and nominal length data input for each seam length section, to the effect that the length data are divided by the respectively associated stitch length in order to obtain the correct stitch length for each seam length section. This stitch number then is calculated for each stored seam length section, which takes place separately for the corresponding seam length sections of the individual sizes of the ready-made garment. For correction, a correction value is also entered e.g. in mm, so that the stored seam length sections can be corrected by a factor so as to change the stitch length. For entering the nominal length data and the correction values, a keyboard (19, 21) is provided in a housing (15) of the control means in conjunction with a display (7). Storage of the seam length sections for one ready-made garment takes place in a pluggable storage module (17).

3 Claims, 1 Drawing Sheet

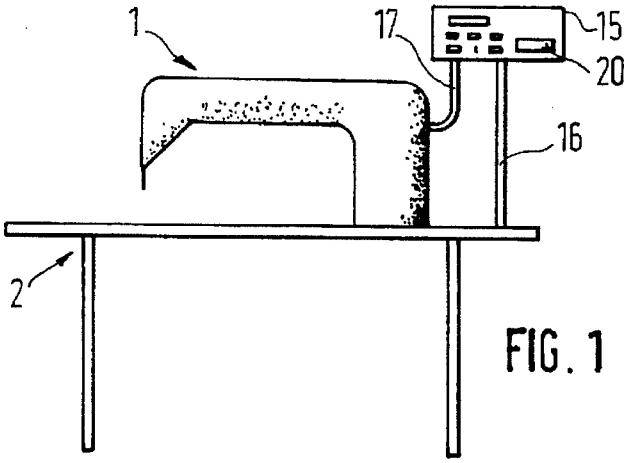
FIG. 1
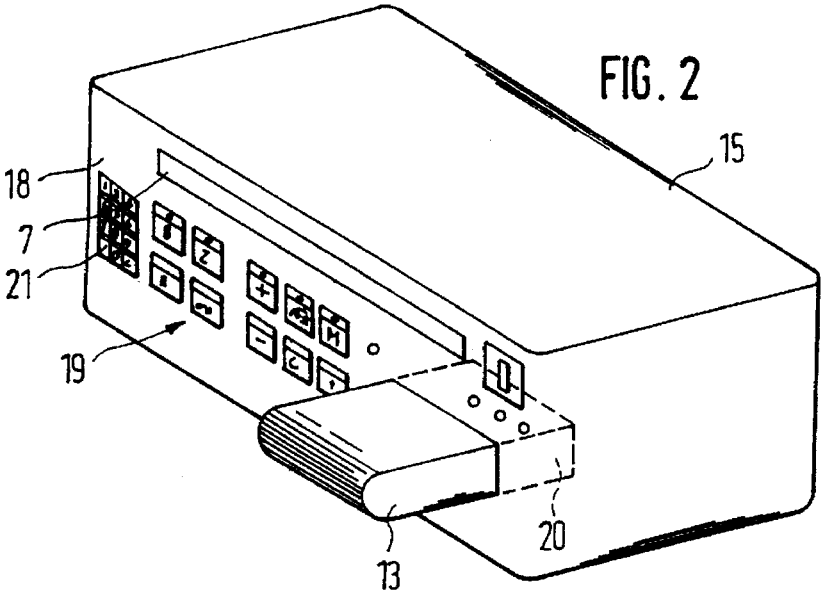
FIG. 2
FIG. 3
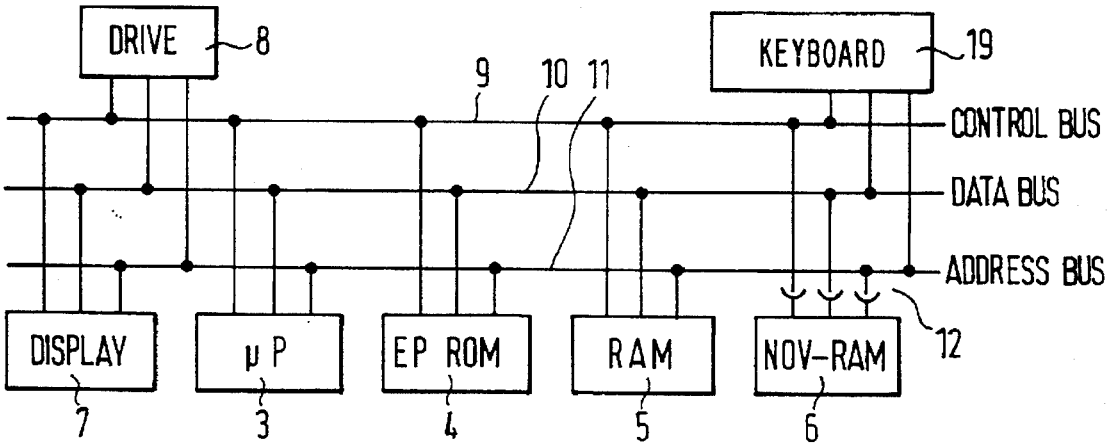

INDUSTRIAL SEWING MACHINE COMPRISING AN ELECTRONIC CONTROL MEANS AND SEWING METHOD

This application is a continuation, of application Ser. No. 08/525,626, filed Oct. 19. 1994, now abandoned which is a cont. of application Ser. No. 08/181,876 filed on Jan. 13, 1994, now abandoned, which is a cont. of application Ser. No. 08/046,894, filed on Apr. 15, 1993, now abandoned, which is a cont. of application Ser. No. 07/825,813, filed on Jan. 21, 1992, now abandoned, which is a cont. of application Ser. No. 07/664,794, filed on Mar. 5, 1991, now abandoned.

The invention relates to an industrial sewing machine comprising an electronic control means triggering and controlling, dependent on the currently produced seam length, one of a variety of functions, with seam length sections each being defined by the product of stitch length and stitch number and the control means therefor processing predetermined stitch lengths and stitch numbers for the function control.

Control of the functions of the sewing machine dependent on the particular seam length produced presupposes that the seam length finished at a particular moment is known at all times. The necessary functions may be triggered then, such as e.g. cutting, label insertion, changing of the differentials for folding or stretching of the fabric.

For determining the seam length produced at a particular moment, a frictional wheel has already been employed which together with an associated measuring sensor was pressed against the fabric for thereby driving the friction wheel by the fabric conveying movement and for causing the measuring sensor to issue path signals. What is problematic in this respect is the placement of the measuring means since, for reasons of the desired accuracy, the latter should be placed as close as possible to the gripper foot, but there impairs the view. In addition thereto, this possibility is expensive.

An electronic control is more favorable in many respects. The applicant already proposed in EP-A-0 148 281 an electronic control means for an industrial sewing machine in which the stitch numbers are input via a keyboard. An internal counter then counts the individual stitches and compares them to preprogrammed values. When there is conformity, the corresponding function is triggered.

As a specific feature in said EP-A-0 148 281, there is provided a non-volatile write/read memory that is connectable to the control means via pluggable connections and has stored in a memory part thereof the program steps for a specific ready-made garment to be made, while, for producing different garment sizes, the associated different stitch numbers are stored in a different memory portion in the form of groups. Each group contains a number of memories for a specific number of stitches each, with the stitch numbers within each group differing in accordance with the particular garment size.

The above-described, known electronic control means has proved successful in practical application. However, there still exist problems in particular as regards corrections or changes in the programs. For instance, when a new series is to be started, it may happen that the previously input nominal values must be corrected since the detection of the actual values has become inaccurate due to changed operating conditions. Depending on sewing material and sewing type, a program may include a considerable number of values so that the corrections are correspondingly complex. In setting a new series, the setter possibly must correct all stitch numbers, this entailing considerable operational expenditure.

It is the object of the invention to make available an industrial sewing machine comprising an electronic control, of the type indicated at the outset, in which the presetting of seam length sections necessary for function control, as well as the correction thereof can be performed with considerably less operational expenditure.

In an industrial sewing machine of the type indicated at the outset, which is provided with an input device, this object is met in that the input device is provided for inputting stitch lengths and nominal and correction values, and in that a calculating unit in the control means divides the nominal length data by the stitch length.

In the industrial sewing machine according to the invention, it is possible to enter via the input device e.g. one single stitch length in connection with several length data. The length data are expediently input in mm. The calculating unit then divides the individual length data by the stitch length (it is also possible to enter several stitch lengths), this resulting in the stitch number for each seam length section. During operation, this stitch number is then compared in known manner to the respectively changing count of a stitch number counter in order to trigger the desired function when there is conformity.

In comparison with the known electronic control means, there is thus a considerably simplified expenditure for setting a new series.

The advantages of the measure according to the invention become evident already with the original programming. Instead of entering a stitch number for each seam length section, it is sufficient to indicate the particular nominal length information and the associated stitch length so that the stitch number is calculated by the calculating unit.

Even more outstanding are the advantages in subsequent corrections when a series is to be set. The setter then merely has to input a correction value (in mm) so that the stitch number for each seam length section can subsequently be corrected automatically on the basis of the correction value input.

For inputting the nominal length data and stitch lengths on the one hand and for inputting correction values on the other hand, there are two variants possible: Upon input of stitch length and nominal length data, the stitch number can be calculated in the electronic control in each individual sewing operation by means of the calculating unit. In case of a correction, the stored nominal length information is then multiplied by a correction value in corresponding manner. In the other variant, the stitch number is first determined and stored in a preparatory operational run after input of stitch lengths and nominal length data for each seam length section. In case of a correction, the correction value indicated in mm is converted into a corresponding factor, and the individual stitch numbers are multiplied by this factor.

According to a specific development of the invention, it is provided that the electronic control comprises as calculating unit a microprocessor and a programmable read-only memory.

The present invention is particularly suited for an industrial sewing machine equipped with a pluggably insertable memory part as described in said EP-A-0 148 281. Accordingly, a further development of the invention provides: a memory part for the program steps of a ready-made garment to be sewn, without the seam length sections (e.g. in the form of stitch numbers) that are different in different garment sizes, and a number of memory groups corresponding to the maximum number of performable program steps and each containing a number of memories for the seam length sections of the individual garment sizes belonging to the program step, with said number corresponding to the number of different garment sizes, and with the memory of each memory group associated with a particular garment size being selected upon input of the garment size by means of a keyboard of the input device.

An embodiment of the invention will now be elucidated in more detail with reference to the drawings in which FIG. 1 shows a schematic view of an industrial sewing machine having a control means fixedly connected thereto, FIG. 2 shows a perspective view of the control means provided with a receptacle for a memory cartridge, and, FIG. 3 shows a block diagram of an embodiment of the electronic part of the control means.

FIG. 1 schematically illustrates an industrial sewing machine comprising a sewing head 1 on a table 2. For controlling the sewing head 1, its drive and the accessory means 20, such as thread cutter, label placing means, piler and the like, there is provided an electronic control means in a housing 15, which is connected via control lines 17 to the sewing head 1 and is supported on the table 2 by a holder 16.

FIG. 2 shows the housing 15 of the electronic control means in a perspective view. Of interest here is merely the front plate 18 of housing 15. Provided on said front plate 18 is a display means 7 which may be in the form of a LCD display having e.g. 32 characters. Furthermore, the front plate 19 includes a keyboard 19 for inputting the commands for programming and control. Moreover, an access opening 20 for a memory cartridge 12 is provided in the front plate 18. Finally, a numerical keyboard 21 is provided on the left-hand portion of the front plate 18.

The cartridge 13, on its side directed towards housing 15, comprises a plurality of plug pins which are adapted to be plugged into corresponding sockets in housing 15.

FIG. 3 shows in a block diagram the structure of the electronic part of the control means. The control means comprises: a microprocessor 3, an EPROM 4, a write/read memory 5 (RAM), a non volatile write/read memory 6 contained in cartridge 13 (FIG. 2), the display means 7, a driving means 8 for the sewing head 1 and the accessory means 20, a control bus 9, a data bus 10 and an address bus 11.

The keyboard portions 19 and 21 are connected to said busses 9, 10, 11 in the manner shown in FIG. 3.

On the lower right of FIG. 3, there are schematically outlined at reference numeral 12 three of 25 pluggable connections located in the inner face side of cartridge 13.

The non-volatile write/read memory, hereinafter referred to as NOV-RAM 6, contains a memory part storing therein the program steps for a specific ready-made garment, without having stored therein the different stitch numbers or nominal seam lengths provided for different garment sizes. In addition thereto the NOV-RAM 6 contains several groups of memories and of counters associated with one memory each. Each memory group is associated with one of the program steps. Each memory of a group contains the different stitch numbers or nominal stitch lengths of the various garment sizes of the garment concerned.

For sewing a specific ready-made garment, the cartridge 13 having the associated sewing program stored in its NOV-RAM 6 is inserted into the cartridge receptacle 20. The selection of the memories having stored therein the stitch numbers or nominal seam lengths of the garment size in which the particular garment is to be sewn, is made by inputting the garment size with the aid of keyboard 19. By doing so, only the stitch numbers or nominal length data belonging to this garment size are interrogated from the memories. By means of the counters, the corresponding stitch numbers are counted in order to trigger a specific function when there is conformity with the previously stored stitch number.

When a change to a different garment size of the same garment is to be made, one merely has to input the new garment size by means of the keyboard 19 or 21 prior to the beginning of the first program step.

Programming of the NOV-RAM 6 can be made with the aid of the keyboards 19 and 21 when the cartridge 13 is inserted into the receiving opening. However, it is also possible to employ a specific programming device for this purpose, which is not shown herein. As regards the particulars of such external programming, reference is made to the aforementioned EP-A-0 148 281.

Input of the seam length sections necessary for function control and function triggering, in contrast to said EP-A, is not made by input of the stitch numbers, but rather a stitch length is entered in conjunction with the nominal length data for the individual seam length sections. It is also possible to enter different stitch lengths for various sections.

This input of stitch lengths and nominal length data for the individual seam length sections is carried out via the keyboard 21, which is a numerical keyboard. The numerical values input are temporarily stored in RAM 5, and the microprocessor 3 calculates from these data the stitch numbers necessary for control of each seam length section, by dividing the individual nominal length data by the associated stitch length. The stitch numbers resulting therefrom are stored in NOV-RAM 6 for one seam length section each. After all values have been stored, the sewing operation can be begun. The stitch numbers can also be calculated continuously during the sewing operation (on-line).

When a new series is to be set, the stitch numbers as a rule must be corrected since, due to changes in the mechanical means or for other reasons, the actual values for the length dimensions have changed. For this purpose, a correction is made with the aid of keyboards 19 and 21, such that a correction length in mm is indicated in addition to the correction commands. The microprocessor 3 calculates from this correction value a correction factor, and all stitch numbers for the individual seam length sections are multiplied (or divided) by this correction factor.

After correction of the individual stitch numbers, the sewing operation may be started again.

In the embodiment described hereinbefore, after the stitch lengths and nominal length data for the individual seam length sections were input, the stitch numbers for the individual sections have been calculated and stored so that they may be retrieved directly. In a modified embodiment it is also possible to store in the NOV-RAM 6 not the calculated stitch numbers, but to store therein directly the length data in mm or in another unit of length.

During the sewing operation these data may then be converted into stitch numbers, with the individual seam length information being divided by the associated stitch length each for this purpose. In a correction, the stored nominal length data are then corrected by means of the entered correction value either by addition or by multiplication. The subsequent operation for calculating the individual stitch numbers is the same as that described hereinbefore.

I claim:

1. An electronic control device for sewing garments of different sizes on an industrial sewing machine, comprising:

program input means for defining different seam length sections on a garment of desired size by a corresponding sewing program, said program input means including length inputting means for inputting at least one length signal related to seam length and stitch length within said sections, adapting means for adapting said sewing program to different garment sizes based on seam length signals and stitch length signals for each section, wherein said adapting means comprises a calculating means for calculating the number of stitches within said sections;

program supplying means for supplying a desired sewing program for said garment, said program supplying means being connected to said program input means; and an intermediate memory device interconnected with said length inputting means and said calculating means, wherein said intermediate memory device comprises a random access memory (RAM).

2. An electronic control device as claimed in claim 1, wherein said program supplying means comprises a program memory device and connection means for removably connecting said program memory device to said program input means.

3. An electronic control device as claimed in claim 2, wherein said program memory device is contained within a cartridge.

* * * * *